United States Patent [19]

Carlson

[11] Patent Number: 4,460,305

[45] Date of Patent: Jul. 17, 1984

[54] STRIP STACKER

[75] Inventor: William J. Carlson, Erie, Pa.

[73] Assignee: Automated Industrial Systems, Inc., Fairview, Pa.

[21] Appl. No.: 395,715

[22] Filed: Jul. 6, 1982

Related U.S. Application Data

[63] Continuation-in-part of Ser. No. 161,136, Jun. 19, 1980, abandoned.

[51] Int. Cl.[3] ..... B65H 31/06

[52] U.S. Cl. ..... 414/108; 271/181; 271/214

[58] Field of Search ..... 414/103, 106, 107, 108, 414/109, 110; 271/181, 214, 215, 217; 53/542

[56] References Cited

U.S. PATENT DOCUMENTS

| | | | |
|---|---|---|---|
| 1,683,982 | 9/1928 | McArthur | 414/108 X |
| 2,132,231 | 10/1938 | Dunser | 414/108 X |
| 2,725,992 | 12/1955 | Wells | 414/108 X |
| 3,001,789 | 9/1961 | Emslie et al. | 271/215 |
| 3,188,945 | 6/1965 | Renauer | 271/181 X |
| 3,263,828 | 8/1966 | Marinoff | 414/106 |
| 3,374,904 | 3/1968 | Francois | 271/181 X |
| 4,151,034 | 4/1979 | Yamamoto et al. | 156/345 |

*Primary Examiner*—Leslie J. Paperner
*Attorney, Agent, or Firm*—Charles L. Lovercheck; Wayne L. Lovercheck; Dale R. Lovercheck

[57] ABSTRACT

A strip stacker for stacking in parallel planes, plate like strips of electronic components. The machine has a trap door onto which the plate like strips are placed in succession. Each time a strip is placed on the trap door its position is sensed by an electronic eye which actuates a motor to swing the trap door down allowing the strip to fall down a slide with its lower edge into a tray. A compacter bar is slideably supported in the tray and two locating pins project into the tray to hold the strips already stacked in position as the compacter bar retracts. Each time a strip falls from the trap door the compacter bar is retracted, the pins retract, and the compacter bar extends forcing the strip against the end until the fallen strip is in position behind the locating pins and pushing the tray down the slides. The locating pins extend holding the last strip against its predecessors. When the tray is full it will be at its lower extreme position and will be removed. The tray support is then driven back to its original position by a motor engaging a rack on the bottom of the tray and the support is thus driven up the slides to its initial loading position.

17 Claims, 11 Drawing Figures

STRIP STACKER

CROSS REFERENCE TO RELATED APPLICATIONS

This application is a continuation-in-part application of Ser. No. 161,136 filed June 19, 1980 which is now abandoned.

GENERAL DESCRIPTION OF THE INVENTION

The machine disclosed herein is suitable for use in maintaining orientation and stacking parts in strip form which have passed through a strip feed system and have been laser marked.

This mechanism is capable of stacking various sizes and configurations of parts in strip form in a box or tray; i.e. electronic components on a die craft strip or on lead frames.

The strip is fed from drive wheel 6, located on the frame 10, into the trap door 1, where its presence is detected by the photo electric eye 2. The trap door 1 is then opened by cylinder 3 and the part falls oriented into the tray 4.

The parts are compacted and stood upright by the compacter bar 5. This also causes the tray 4 to move on the guide rods 16 making room or the next strip 12.

The detent pins 7 are extended and hold the parts upright while the compacter bar 5 is retracted. The detent pins 7 retract allowing the compacter bar 5 to extend, compacting the strips against the end of the tray 4 and forcing the tray and tray support to move on the guide rods 16. The detent pins extend, fitting into a notch in the front of the compacter bar. The compacter bar retracts and the detent pins hold the strips behind them.

When the tray 4 has traveled the length of the slides 16 and is filled with strips 12, limit switch 21 shuts down the Strip Feed System.

The operator manually removes, empties, and replaces the trays 4. After actuating the start cycle switch, the tray is driven back to its home position by the gear and rack (20 and 8 respectively) powered by motor 9 and the sequence begins again.

REFERENCE TO PRIOR ART

Patents of the general nature of that disclosed herein are: U.S. Pat. No. 3,013,672; U.S. Pat. No. 3,072,051; U.S. Pat. No. 3,883,131; U.S. Pat. No. 3,888,363; and U.S. Pat. No. 4,151,034.

None of these patents disclose the invention disclosed herein.

OBJECTS OF THE INVENTION

It is an object of the invention to provide an improved strip stacker.

Another object of the invention is to provide a strip stacker that will take strips from a horizontal track and stack them on edge in a tray.

Another object of the invention is to provide an improved strip loader and stacker.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 11 is a schematic wiring diagram for the invention.

DETAILED DESCRIPTION OF THE DRAWINGS

Now, with more particular reference to the drawings, a strip stacker is disclosed attached to a fixed frame 10 made up of two vertically extending, generally parallel members that are held together in rigid relationship by a bottom member and a top member as shown. The strip stacker is adapted to receive electronic parts on strips 12 which can be fed by hand or by an automatic machine having a horizontally disposed track that will align with the guide rails 19 which support the strips 12 in a horizontal plane. The strips 12 have individual electronic components attached to them. The electronic components are generally rectangularas shown, have lead wires that extend from them and are disposed between the paper strips.

Figure 2:
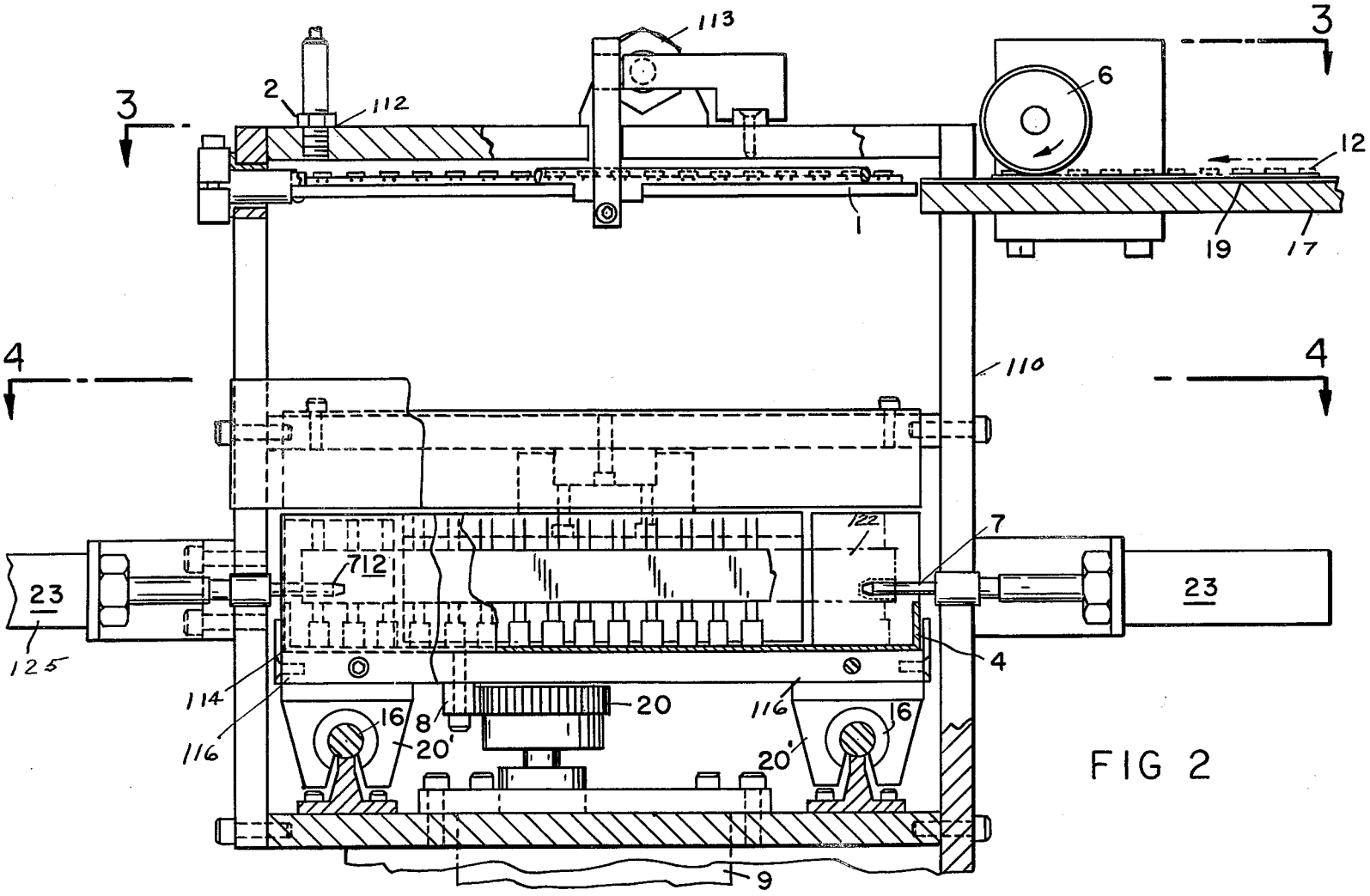
FIG. 2 is a cross sectional view of the strip stacker taken on Line 2—2 of FIG. 1.
Figure 3:
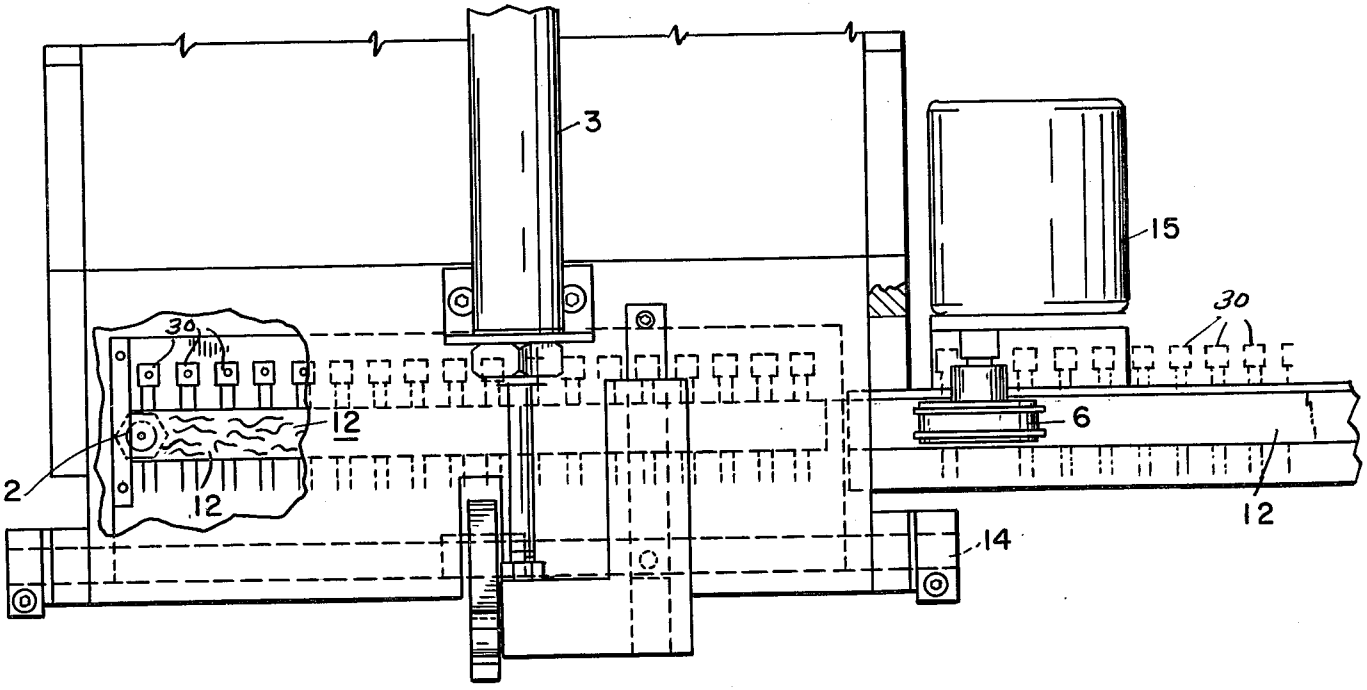
FIG. 3 is a cross sectional view of the strip stacker taken on Line 3—3 of FIG. 2.
Figure 4:
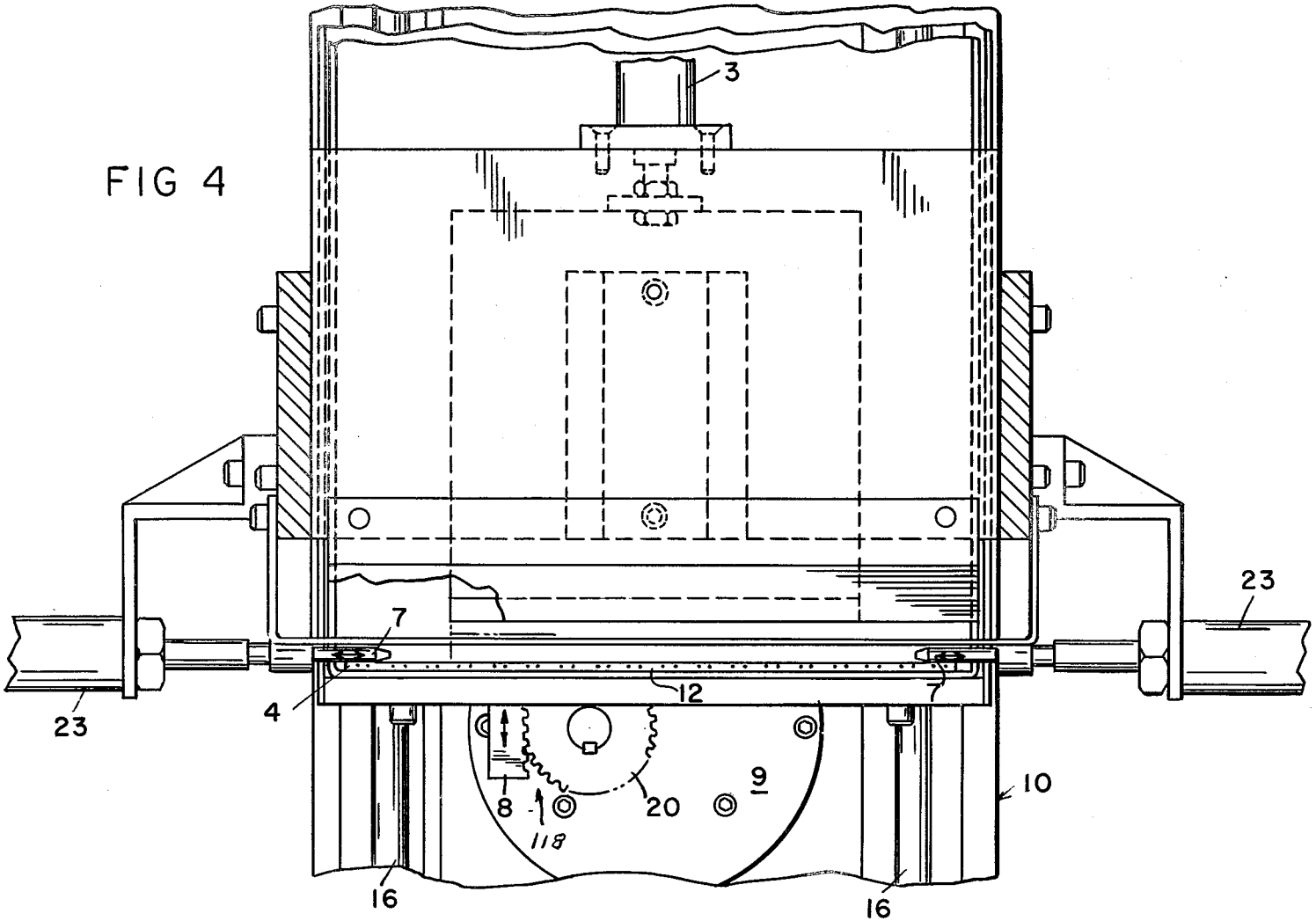
FIG. 4 is a cross sectional view of the strip stacker taken on Line 4—4 of FIG. 2.

The drive wheel 6 is powered by motor 15 which drives the strips into position on the trap door 1. The trap door 1 forms a continuation of the guide rails 19 so that the strips 12 move smoothly from a position shown at the right of FIG. 2 to the position on top of the trap door 1. The trap door 1 is swingably connected to the upper part of the frame of the machine by pivot 14. When the strip 12 moves into position over the trap door, the trap door will swing downward and open about its pivot 14 by means of air cylinder 3 which has a piston rod connected to the bell crank mechanism 17 that swings about pivot 14 carrying the trap door. When open, the trap door allows the strip 12 to fall along the part guide 18 into the tray 4.

The machine has two inclined guide rods 16 that are attached to the frame 10 and extend downward and under the trap door 1. The tray support 11 carries the trays down the inclined guide rods 16 as they fill with strips 12. The tray support 11 has brackets 20' that extend downward and that are slideably received on the rods 16. These brackets are attached to the bottom part of the tray support 11 and exert a frictional force on the rods 16 and therefore restrain the movement of the tray support 11 on the rods 16. The tray support has an end member 22 and a bottom attached to it. The trays 4 are received on the tray support 11 and the end of the tray 4 rests against the end 22 of the tray support 11. A compacter bar 5 is supported on a piston rod of cylinder 13 and can move toward and away from the end 22 of the tray support. The compacter bar 5 is received in the tray and it retracts away from the end of the tray 4 to a position spaced therefrom to allow the strips 12 to fall down from the trap door 1.

When a strip is fed by wheel 6 onto the trap door, its presence is detected by photo electric eye 2. The trap door is then opened by cylinder 3 and the strip falls oriented by guide part 18 into tray 4. The parts are compacted and stood upright by compactor bar 5. This also pushes the tray ahead moving brackets 20' on rods 16.

Figure 5:
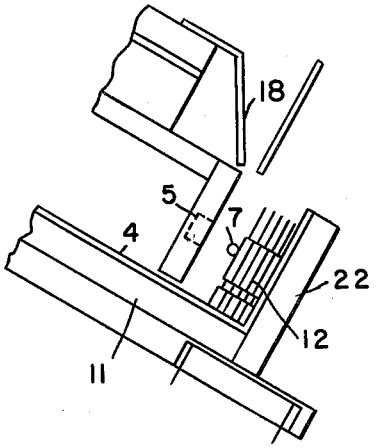
FIG. 5 is a schematic view of the strip stacker with the compacter bar retracted, detent pins extended ready for a strip to be dropped.
Figure 6:
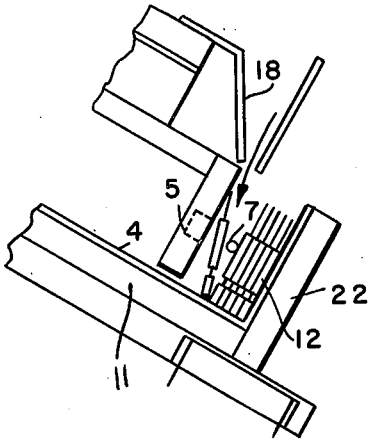
FIG. 6 is a schematic view of the strip stacker with compacter bar retracted, a strip dropped from the guide rail into the tray and the detent pins extended.
Figure 7:
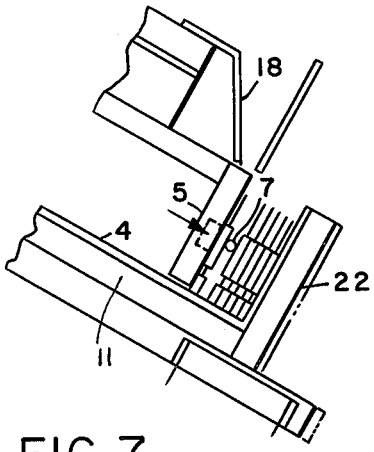
FIG. 7 is a schematic view of the strip stacker with the strip dropped into position and the detent pins retracted and the compacter bar partially extended, beginning to force the strip into position.
Figure 8:
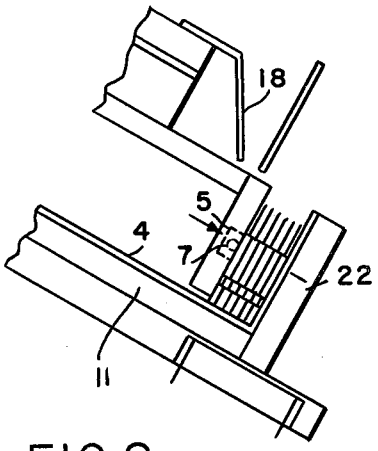
FIG. 8 is a schematic view of the strip stacker with detent pins retracted and compacter bar fully extended forcing strips together and tray down the incline the width of one strip.
Figure 9:
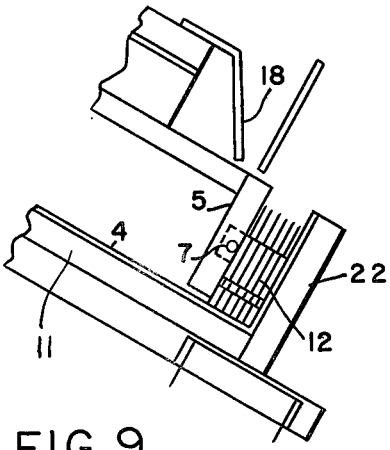
FIG. 9 is a schematic view of the strip stacker with the compacter bar fully extended ready to retract and the detent pins extended holding the strips in position against the end of the tray.
Figure 10:
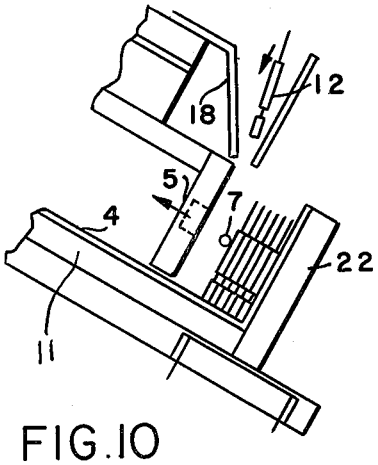
FIG. 10 is a schematic view of the strip stacker with the detent pins extended and compacter bar retracted ready for another strip to be dropped.

The compacter bar is retracted when the strip falls as shown in FIG. 5 and FIG. 6. The detent pins 7 will then be retracted by means of cylinders 23 which may be air actuated, electrically actuated, or actuated by any other suitable means. The compacter bar 5 then extends partially, beginning to force the strip 12 into position as shown in FIG. 7. The compacter bar 5 fully extends forcing the strips together and the tray down the incline the width of one strip as shown in FIG. 8. The detent pins 7 then extend fitting into a notch in the compacter bar 5 as shown in FIG. 9. The compacter bar 5 then retracts and the detent pins 7 hold the strips in position as shown in FIG. 10. The machine is now ready for another strip to fall into the tray.

Figure 1:
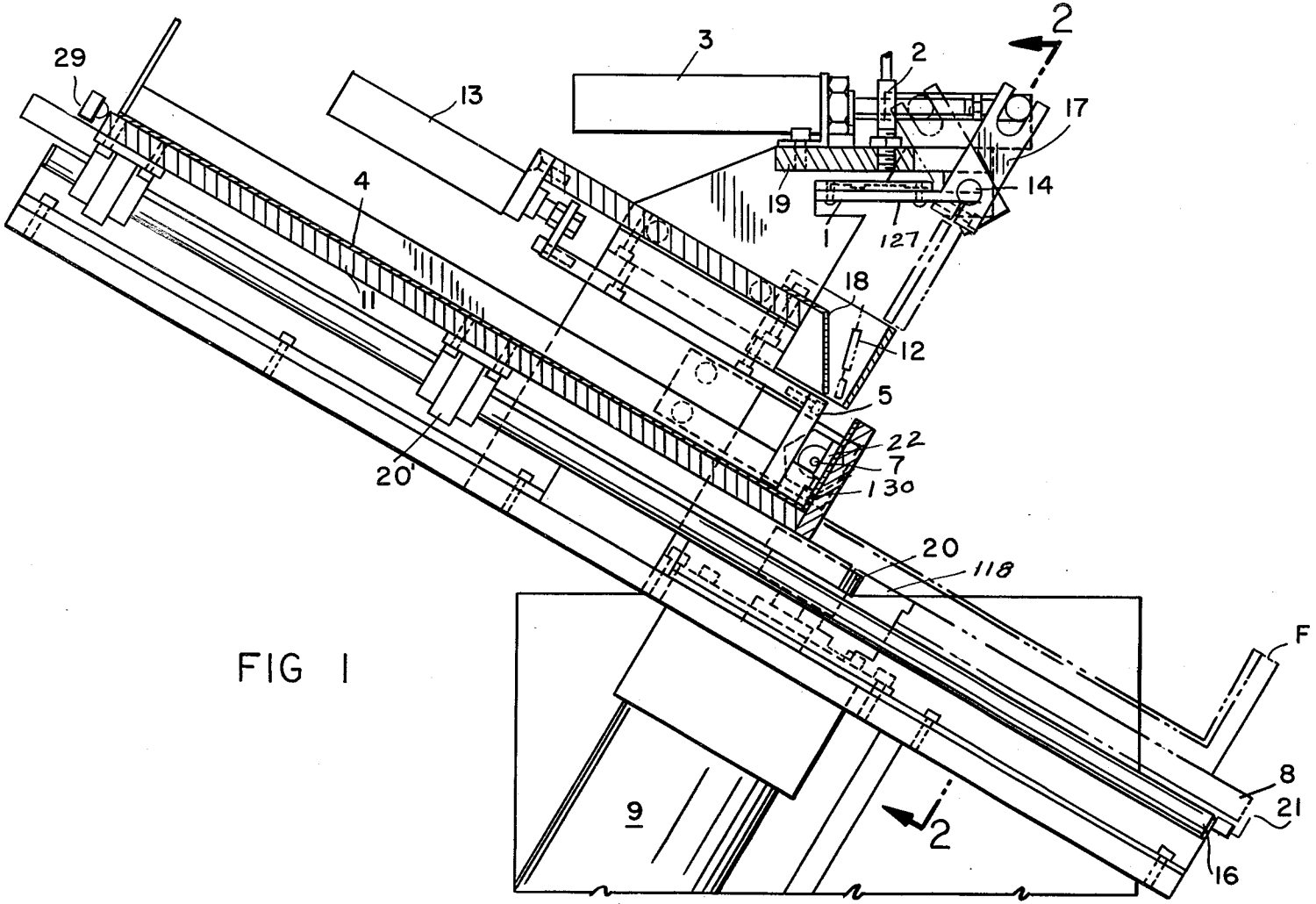
FIG. 1 is a cross sectional view of the strip stacker taken on Line 1—1 of FIG. 2 according to the invention.

When a tray is full the tray will be in position F as indicated in phantom lines on FIG. 1. A limit switch 21 shuts down the Strip Feed System when the tray reaches position F. The operator will then remove the tray 4 from the strip stacker and empty it into a shipping box or other repository. The empty tray is returned by push button 24 to its beginning position by the gear 20 and rack 8 powered by motor 9. The rack bar attached to the bottom of the tray extends generally parallel to the rods 16.

Master switch 25 turns the strip stacker on by allowing current to flow through limit switch 21 and through motor 15 which powers drive wheel 6. A strip is fed onto the trap door 1. Photo electric eye 2 detects the position of the strip on the trap door 1 and signals to allow current to flow through cylinder 3 which opens the trap door 1. The photo electric eye 2 also permits the current to flow through delay mechanisms connected in parallel with the cylinder 3.

The delay mechanism 28 delays the current for a short time before it reaches cylinders 23 which retract the detent pins 7. The delay mechanism 27 delays the current for a short time after the detent pins retract. Then current flows through cylinder 13, allowing the compacter bar 5 to extend compacting the strips. The detent pins 7 then extend by means of cylinders 23 which are controlled by timer 31. Then timer 31 allows current to flow through cylinder 13 to retract the compacter bar 5.

When photoelectric eye 2 detects another strip 12 positioned on the trap door 1, the trap door opens and the strip falls and is compacted. When the tray 4 is filled with strips, it is in the position indicated in phantom lines on FIG. 1. Limit switch 21 opens the connection to motor 15, thereby stopping drive wheel 6. After the full tray has been replaced with an empty tray, the operator pushes button 24 to allow current to flow to motor 9. Motor 9 powers gear 20 to rack 8 to drive the tray 4 and tray support 11 to the beginning position. The tray no longer pushes limit switch 21, so the connection closes and current flows through limit switch 21 to motor 15 to power drive wheel 6. The tray pushes limit switch 29, breaking the connection to motor 9. Motor 9 turns off. Drive wheel 6 feeds in strips and the tray begins to fill as the cycle repeats.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A strip stacker apparatus comprising guide rails (19) on said apparatus, for supporting strips (12) supported in a generally horizontal plane to be stacked in a tray (4) in generally vertical planes, inclined guide rod support means (16) for said tray (4) and a tray support (11) below said guide rails for supporting said tray in a position inclined to said horizontal plane, a trap door (1) in said guide rails, friction means (20') to resist movement of said tray support on said inclined guide rods (16) holding said tray (4), a tray support having a bottom and an end (22), a tray (4) on said support means, said tray (4) comprising a bottom and an end extending upwardly from said bottom, said tray bottom resting on said tray support (11), a compacter bar (5) received in said tray (4), arm means to reciprocate said compacter bar (5) from a retracted position spaced from said tray end to a position engaging strips in said tray (4) resting against said tray end and to slide said tray against the force of said friction to a position to make room for the next strip, detent pins (7), one of said detent pins (7) being disposed on said machine at each side of said tray (4), cylinder means (23) to extend said detent pins horizontally into said tray into engagement with said strips when the compacter bar is retracted, means to open said trap door to move said trap door from a said strip allowing said strip to fall into said tray between said compacter bar and said tray end, and cylinder means (23) to withdraw said pins momentarily to allow said strip last fallen through said trap door to move behind said detent pins, and means (20, 8) attached to said tray support engaging drive means (9) on said stacker for driving said tray support to home position when said tray is filled with strips.

2. A strip stacker apparatus comprising guide rails for supporting strips supported in a generally horizontal plane to be stacked in a tray in generally vertical planes, inclined guide rod support means for said tray and a tray support below said guide rails, a tray door between said guide rails, friction means to resist movement of said tray support on said guide rails holding said tray from sliding on said inclined guide rod support means, a tray on said support means, said tray comprising a bottom and an end extending upwardly from said bottom, said tray bottom resting on said tray support, a compacter on said tray support and adapted to be received in said tray, arm means to reciprocate said compacter from a retracted position spaced from said end to a position engaging strips in said tray resting against said end and to slide said tray against the force of said friction to a position to make room for the next strip, detent pins, one of said detent pins being disposed on said machine at each side of said tray, means to extend said detent pins horizontally into said tray into engagement with said strips when the compacter is retracted, means to open said trap door to move said trap door from a said strip allowing said strip to fall into said tray between said compacter and said end, and means to withdraw said pins momentarily to allow said strip last fallen through said trap door to move behind said detent pins, a rack fixed to said tray support and a motor driven pinion on said strip stacker engaging said rack for driving said tray support to home position when a said tray is filled with said strips.

3. The apparatus recited in claim 2 wherein actuating means for said trap door is provided, said actuating means comprising a photo electric eye (2) to sense the position of said strips to open said trap door each time as said strip is moved over said trap door (1).

4. The apparatus recited in claim 3 wherein said guide rod supports comprise two spaced rod tracks (16) on said frame (10) disposed at an acute angle to the horizontal.

5. The apparatus recited in claim 4 wherein a motor (9) is supported on said frame driving a gear with said gear engaging said rack for moving said tray support to starting position after each tray is filled with strips.

6. The apparatus recited in claim 2 wherein said means to extend said detent means comprises a linear motor (23).

7. The apparatus recited in claim 2 wherein said compacter arm is actuated by a fluid operated cylinder (13) supported on said machine.

8. The apparatus recited in claim 2 wherein said trap door mechanism comprises a door (1) approximately the same length as said strips (12) and comprising a continuation of said guide rails and track.

9. The apparatus recited in claim 8 wherein said trap door mechanism comprises a hinge swingable about a horizontal pin (14) pivoted parallel to said guide rails and disposed at one said thereof.

10. The apparatus recited in claim 9 wherein said hinge pin has a bell crank (17) attached thereto and a cylinder (3) having a piston fixed to said frame and a piston rod attached to said bell crank for swinging said trap door when said piston receives a signal from a signal means (2) on said machine.

11. The apparatus recited in claim 10 wherein said signal means comprises a photocell eye (2) supported on said machine and adapted to detect the position of said strip (12) on said trap door (1).

12. The apparatus recited in claim 11 wherein said tray support is restrained from sliding on said inclined guide rods (16) by friction on said rods.

13. The apparatus recited in claim 12 wherein a motor (15) and a drive wheel (6) comprise a feed system, a limit switch (21) shuts down said feed system when said tray is filled, and a limit switch (29) actuates said motor (9) for returning said tray to its beginning position.

14. The strip stacker recited in claim 2 wherein drive means is fixed to said tray support and driven means engages said drive means for driving said tray support to its home position when a said tray is filled with said strips.

15. A strip stacker apparatus comprising guide rails for supporting strips supported in a generally horizontal plane to be stacked in a tray in generally vertical planes, inclined guide rod support means for supporting a tray support below said guide rails, a trap door between said guide rails, bracket means slideably supported on said inclined guide rod support means, said brackets having friction means thereon to exert a frictional force on said inclined guide rods restraining the sliding of said brackets on said inclined rods, a tray supported on said tray support, means to move said strips over said trap door to pass through said trap door into said tray on said inclined rods, a tray support on said brackets, said tray support comprising a bottom and an end extending upwardly from said bottom, a compacter bar received in said tray, friction means on said tray support to resist the movement of said tray support on said inclined guide rods, means to reciprocate said compacter from a retracted position spaced from said tray end to a position engaging strips in said tray resting against said tray end and to slide said tray on said inclined guide rods against the force of friction of said brackets on said rods whereby as each strip is deposited in said tray, said tray is advanced down said rods the thickness of one said strip to a position to make room for the next strip, motor means on said stacker and connected to said tray support to return said tray support to home position after said tray has been filled with strips.

16. The machine recited in claim 15 wherein detent pins are disposed at each side of said tray, means to extend said detent pins horizontally into said tray into engagement with said strips when the compacter is retracted, means to open said trap door to allow a strip to fall into said tray between said compacter and said end, and means to withdraw said pins momentarily to allow said strip last fallen through said trap door to move behind said detent pins.

17. The apparatus recited in claim 15 wherein said tray support has a rack fixed thereto, a pinion engaging said rack and a motor driving said pinion for driving said tray rack to its home position when said tray is filled.

* * * * *